United States Patent [19]

Dholakia

[11] 4,428,165

[45] Jan. 31, 1984

[54] FLIP-FLOP GRINDING METHOD

[75] Inventor: Anil R. Dholakia, East Windsor, N.J.

[73] Assignee: RCA Corporation, New York, N.Y.

[21] Appl. No.: 292,284

[22] Filed: Aug. 12, 1981

[51] Int. Cl.[3] ..... B24B 1/00

[52] U.S. Cl. ..... 51/283 R; 51/326

[58] Field of Search ..... 51/283 R, 283 E, 281 R, 51/285, 326, 327, 125.5, 229; 163/5; 369/71, 170–173

[56] References Cited

U.S. PATENT DOCUMENTS

| | | | |
|---|---|---|---|
| 969,896 | 9/1910 | Morse | 163/5 |
| 2,205,964 | 6/1940 | Taylor | 51/227 H |
| 4,104,832 | 8/1978 | Keizer | 51/281 R |
| 4,162,510 | 7/1979 | Keizer | 358/128 |
| 4,164,755 | 8/1979 | Matsumoto | 358/128 |
| 4,165,560 | 8/1979 | Matsumoto | 29/630 R |
| 4,365,447 | 12/1982 | Dholakia | 51/220 |
| 4,369,604 | 1/1983 | Kaganowicz | 51/281 R |

*Primary Examiner*—Frederick R. Schmidt
*Assistant Examiner*—Robert A. Rose
*Attorney, Agent, or Firm*—Birgit E. Morris; Donald S. Cohen; Joseph D. Lazar

[57] ABSTRACT

A method for lapping two flats of substantially the same dimensions in an element having a cone-shaped tip. The method includes the steps of contacting a first region of the cone wherein a flat is to be lapped while the cone is in contact with the lapping surface; rotating the element to a second region wherein a second flat is to be lapped while the tip is in contact with the lapping surface without the cone tip contacting or disturbing the lapping surface; contacting the second region of the cone with the abrasive lapping surface for a predetermined time; and repeating the previous steps until the two flats have been lapped. The time each region contacts the lapping surface is substantially equal and the time during which the element is rotated is small compared to the time each region contacts the lapping surface.

5 Claims, 11 Drawing Figures

10
2
4
6
7
8
12
14
16
18
20
24
26
30

FLIP-FLOP GRINDING METHOD

This invention relates to a method for manufacturing a capacitive information disc playback stylus.

BACKGROUND OF THE INVENTION

Matsumoto, in U.S. Pat. Nos. 4,164,755 and 4,165,560, discloses a pickup stylus for use with a capacitive information disc and a method for manufacturing the stylus. The stylus is fabricated from a tapered diamond support element having, in the region of its tip, a plurality of conical portions with a common axis. Two of the conical portions are separated by an electrode bearing surface. A record engaging surface is provided in the tip region substantially orthogonal to the electrode bearing surface. The diamond support element includes a pair of converging flat surfaces in the tip region which are disposed such that the intersection of the converging flat surfaces with the record engaging surface defines the side edges of the record engaging surface. The intersection of the converging flat surfaces with a conical portion remote from the electrode bearing surface forms a prow.

The Matsumoto stylus may be manufactured by grinding a conical surface at one end of the diamond element. An electrode bearing surface in the region of the tip and a record engaging surface substantially orthogonal to the electrode bearing surface are formed. A pair of converging substantially flat surfaces are also formed in the region of the tip such that the intersection of the converging flat surfaces with the record engaging surface defines the sides of said record engaging surface.

Keizer, in U.S. Pat. Nos. 4,104,832 and 4,162,510, has disclosed a keel-tipped capacitive information system playback stylus and a method for forming the stylus. The terminating portion of the stylus is shaped to have a prow, a substantially flat rear surface remote from the prow, a pair of substantially parallel side surfaces extending from the side edges of the rear surface, a bottom surface extending from the bottom edge of the rear surface and additional surfaces extending from the prow and intersecting the bottom and side surfaces.

The keel-tipped stylus may be formed with an abrasive lapping disc having a deep, coarse-pitched groove. The tip is fabricated from a tapering support element which is defined at one end by a prow and a substantially flat "V"-shaped rear surface remote from the prow. The lands on the lapping disc lap the shoulders of the stylus. The walls of the abrasive groove form the substantially parallel side surfaces.

I have made a keel-tipped stylus from a support element having a conical tip. The resulting stylus maybe used to recover information from an information track from either a grooved or ungrooved capacitive information disc. In order to obtain the prow and substantially flat "V"-shaped rear surface, I lap an electrode surface and a pair of converging flat surfaces in the tip region which meet to form a point.

I have found that it is difficult to form the pair of converging substantially flat surfaces of substantially the same dimensions such that they meet at the end of the electrode surface. Because of nonuniformities which may occur in the grinding medium, the intersection of the two converging surfaces with the electrode surface may be substantially off-center relative to the stylus axis. This off-center convergence leads to difficulties in forming a record engaging surface.

SUMMARY OF THE INVENTION

I have found a method for lapping two flats of of substantially the same dimensions in an element having a cone-shaped tip. The method includes the steps of contacting a first region of the cone wherein a flat is to be lapped with an abrasive lapping surface for a predetermined time, rotating the element to a second region wherein a flat is to be lapped while the cone is in contact with the lapping surface without the cone tip contacting or disturbing the lapping surface, contacting the second region of the cone with the abrasive lapping surface for a predetermined time, and repeating the previous steps until the two flats have been lapped. The time each region contacts the lapping surface is substantially equal and the time during which the element is rotated is small compared to the time each region contacts the lapping surface.

DETAILED DESCRIPTION OF THE INVENTION

Figure 1:
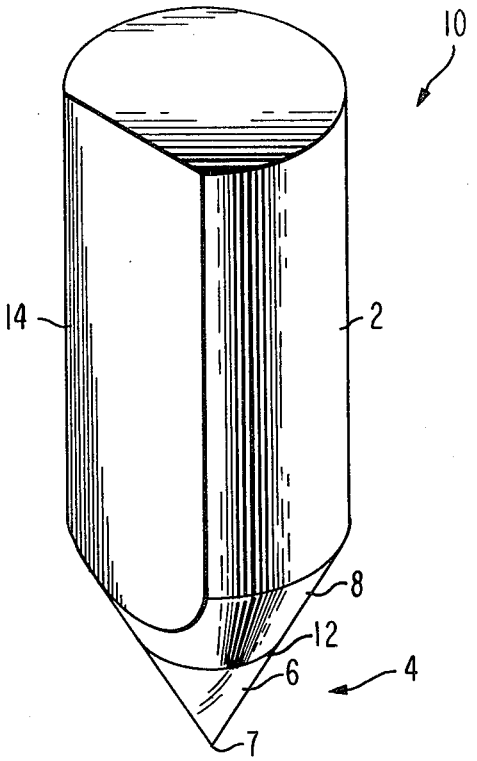
FIG. 1 is a perspective view of a stylus element having a reference flat.

In the present invention a flip-flop motion of the stylus element conical tip on an abrasive surface is employed in order to obtain two flats at the tip of the stylus element which are substantially equal. The flip-flop motion allows for the averaging out of the effects of inhomogeneities of the abrasive surface which I have observed to occur. Furthermore, the flip-flop motion wherein each region of the stylus tip to be lapped contacts the abrasive surface for a substantially equal time allows for the process to be automated. The time wherein the stylus element is rotated between the two regions to be lapped is short relative to the time the stylus element spends in the lapping region so that unwanted gouging or flattening of the stylus tip in the region which, acts as a pivot is avoided. The use of the pivot also allows the regions to be lapped to contact the lapping surface in a relatively gentle manner which minimizes unwanted chipping. The region between the two flats, over which the pivotting occurs, is somewhat rounded during the flip-flop grinding operation.

During rotation between the two tip regions to be lapped, the tip end should not contact or penetrate the lapping abrasive surface. Serious damage to the abrasive surface may occur upon penetration. Also, the tip end contacting the abrasive surface may lead to the removal of the abrasive particles responsible for removing the unwanted stylus element tip material.

I have found that it is preferable not to lap a surface region to completion before lapping the second region, but rather to rotate between the regions frequently. When lapping of the regions is initiated, shorter contact times between the region and the abrasive surface are preferred. Because of the small surface area initially lapped, the pressure on the abrasive surface is high which may result in damage to or removal of the abrasive surface. It is, therefore, preferable to minimize the contact time until there has been a larger flat region lapped.

The axis of rotation during the flip-flop may be the axis of the stylus element or any other desired axis of rotation so long as the tip end does not disturb or penetrate the abrasive surface.

This invention will be further illustrated by means of the Drawing. However, it is to be understood that the scope of the invention is not meant to be limited by the details described therein.

FIG. 1 is a perspective view of a stylus element 10. The stylus element 10 has a shank 2 and a conical tip region 4. The shank 2 material may, for example, be a metal such as titanium or the same material as that which will contact with the capacitive information disc during playback, e.g., sapphire, diamond and the like. The tip region may consist of two components 6 and 8, wherein the first tip region component 6 which terminates at tip end 7 includes the tip region 4 portion which will contact the capacitive information disc during playback and is generally a hard dielectric material such as diamond, sapphire and the like. The second tip region component 8 may be fabricated from the same material as the first tip component 6 or the shank 2 material. The interface 12 between the second tip region component 8 and the first tip region component 6 is shown for the case where the first and second tip region components, 6 and 8, respectively, are fabricated from different materials. The two tip component regions, 6 and 8, may be bonded at the interface 12 by brazing, soldering or by any other suitable method known in the art. A reference flat 14 may be machined into the stylus element 10.

Figure 2:
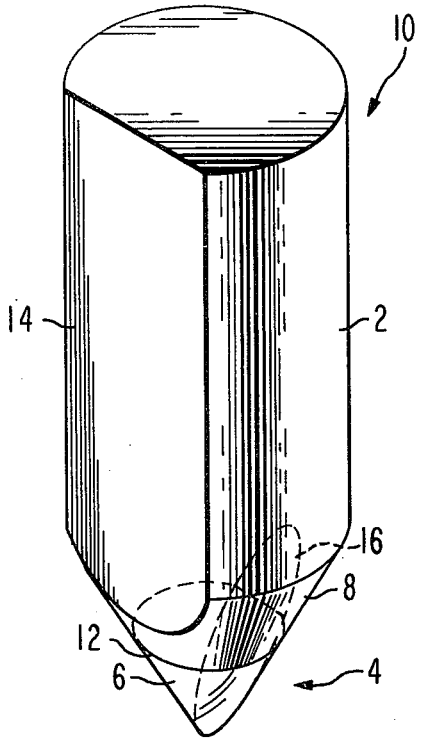
FIG. 2 is a perspective view of a stylus element having a reference flat and an electrode surface.

FIG. 2 is a perspective view of a stylus element 10 in which an electrode surface 16 has been lapped as a flat opposite the reference flat 14. The reference flat 14 serves as a means to orient the stylus element 10. In lapping the electrode surface 16 as well as lapping other flats, any convenient method may be employed. For lapping a first tip component 6 which is diamond, a diamond powder having average particle diameter of between about 0.1 to 0.25 micrometer may be employed as the charge on a scaife which acts as the abrasive surface. The electrode surface 16 may be made conductive, for example, by coating with a metal such as titanium, hafnium and the like or by ion implantation.

Figure 3:
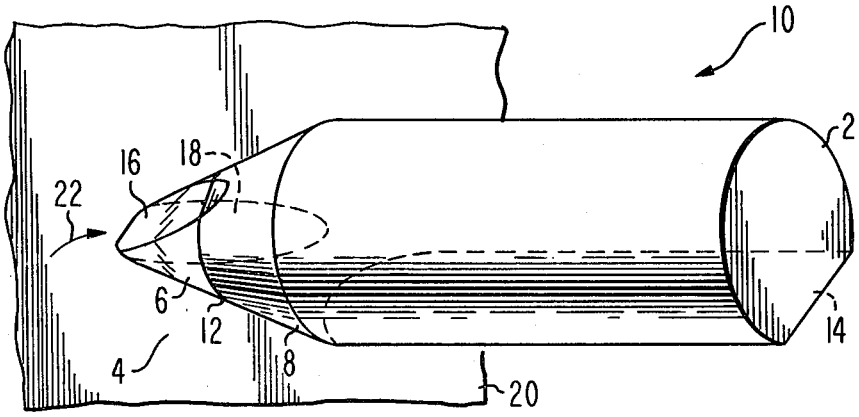
FIG. 3 is a planar view of the grinding of a first flat in a stylus element.

FIG. 3 is a planar view illustrating the lapping of a first flat 18 in a stylus element 10. The first flat 18 is lapped on an abrasive surface 20. The direction of rotation of the abrasive lapping surface 20 during lapping is shown by a first arrow 22.

Figure 4:
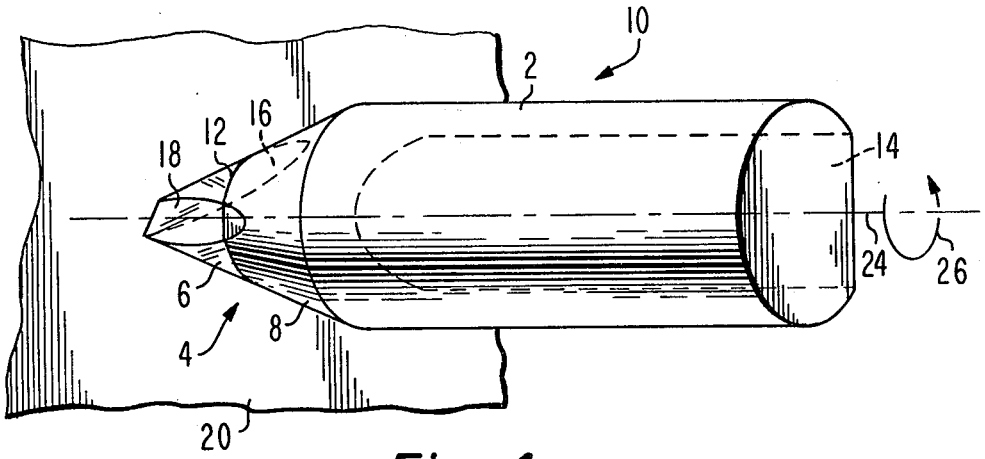
FIG. 4 is a planar view of the rotation of a stylus element after lapping of a first flat.

FIG. 4 is a planar view of the stylus element 10 which has been rotated about its principal axis 24 in the direction shown by a second arrow 26. The stylus element 10 has been rotated to a position on the tip region 4 which is intermediate between the first flat 18 which has been lapped and the second region wherein a second flat 28, not shown, is to be lapped.

Figure 5:
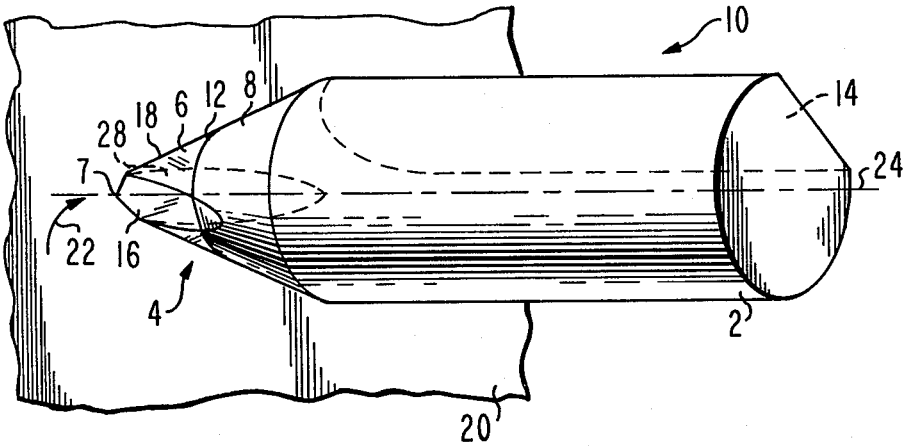
FIG. 5 is a planar view of a stylus element in which a second flat is being lapped.

FIG. 5 is a planar view showing the lapping of the second flat 28 in the stylus element 10. The first flat 18 and the second flat 28 intersect the electrode face 16 at the tip end 7 so that the electrode face terminal portion is V-shaped. The flip-flop grinding operation steps are repeated until the first flat 18 and the second flat 28 have obtained the desired dimensions. The use of the flip-flop method results in the tip end 7 being substantially centered on the electrode surface 16.

Figure 6:
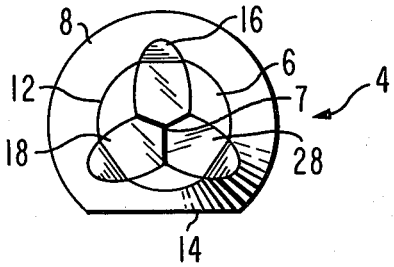
FIG. 6 is a frontal view of a tip of a stylus element after the two flats and electrode suface have been lapped.

FIG. 6 is a frontal view of the stylus element 10 after the lapping operations to form the first flat 18, the second flat 28 and the electrode surface 16 have been completed.

Figures 7A, 7B, 7C:
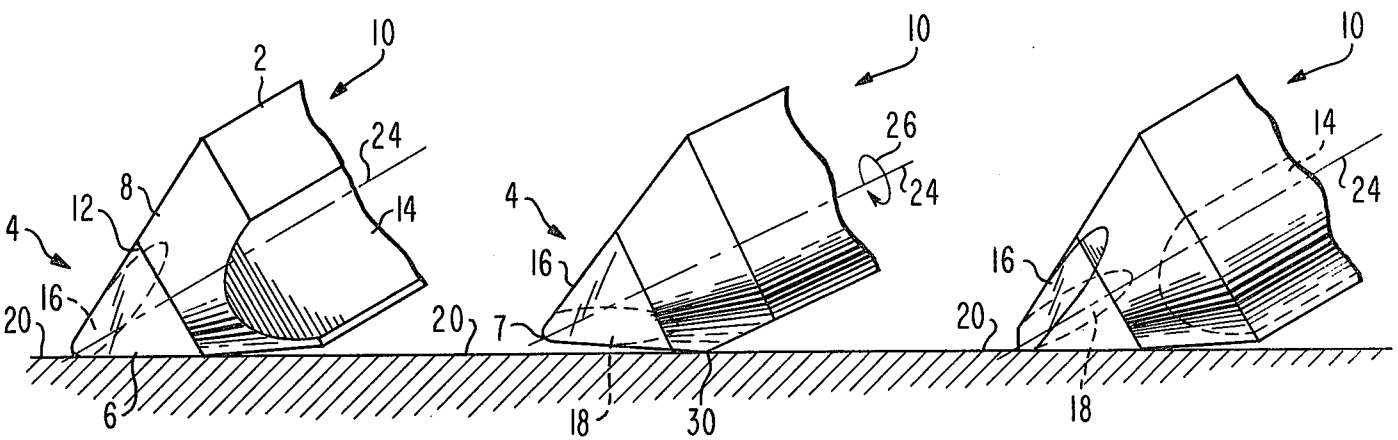
FIGS. 7A–7C are elevational views of the grinding of the two flats and the rotation of the stylus element.

FIGS. 7A, 7B and 7C are elevational views of the stylus element 10 during the flip-flop grinding operation. In FIG. 7A the first flat 18 is being lapped in the tip region 4 on the abrasive lapping surface 20. In FIG. 7B the stylus element 10 is being rotated about its major axis 24. The tip end 7 is elevated during the rotation process. The tip region 4 rotates about a pivot 30, which is a portion of the tip region. In FIG. 7C the second flat is being lapped. As previously discussed, the flip-flop steps, as shown in FIGS. 7A, 7B and 7C, are repeated until the two flats 18 and 28 have been lapped to have the desired dimensions.

Figure 8:
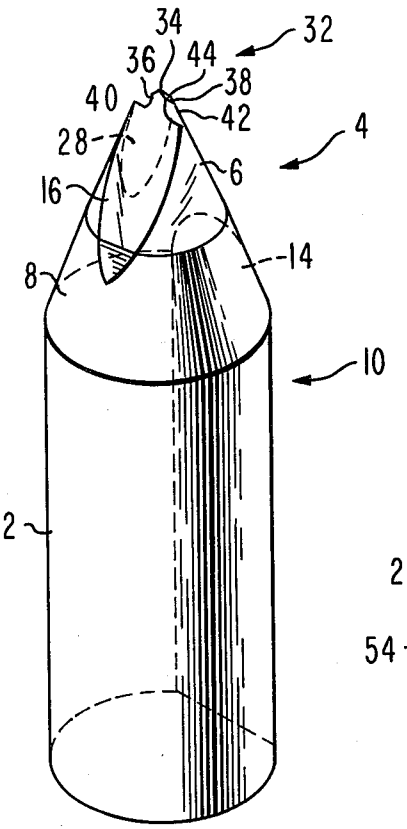
FIG. 8 is a perspective view of the stylus element after keel-lapping.

FIG. 8 is a perspective view of a stylus element 10 showing the keel-tip 32 lapped into the tip region 4. The keel-tip 32 includes a bottom surface 34 which engages a capacitive information disc, not shown. For a grooved disc, the bottom surface 34 is generally V-shaped so as to conform to the groove shape of the capacitive information disc. The keel-tip 32 also includes sides 36 and 38, and shoulders 40 and 42, which are joined to their respective sides by means of a concave junction. A curved prow 44 is present opposite the electrode surface 16. The keel tip 32 may be lapped by means of an $SiO_x$ coated abrasive lapping disc wherein the $SiO_x$ coating is prepared from $N_2O$ and $SiH_4$ precursors by the glow discharge deposition technique.

Figure 9:
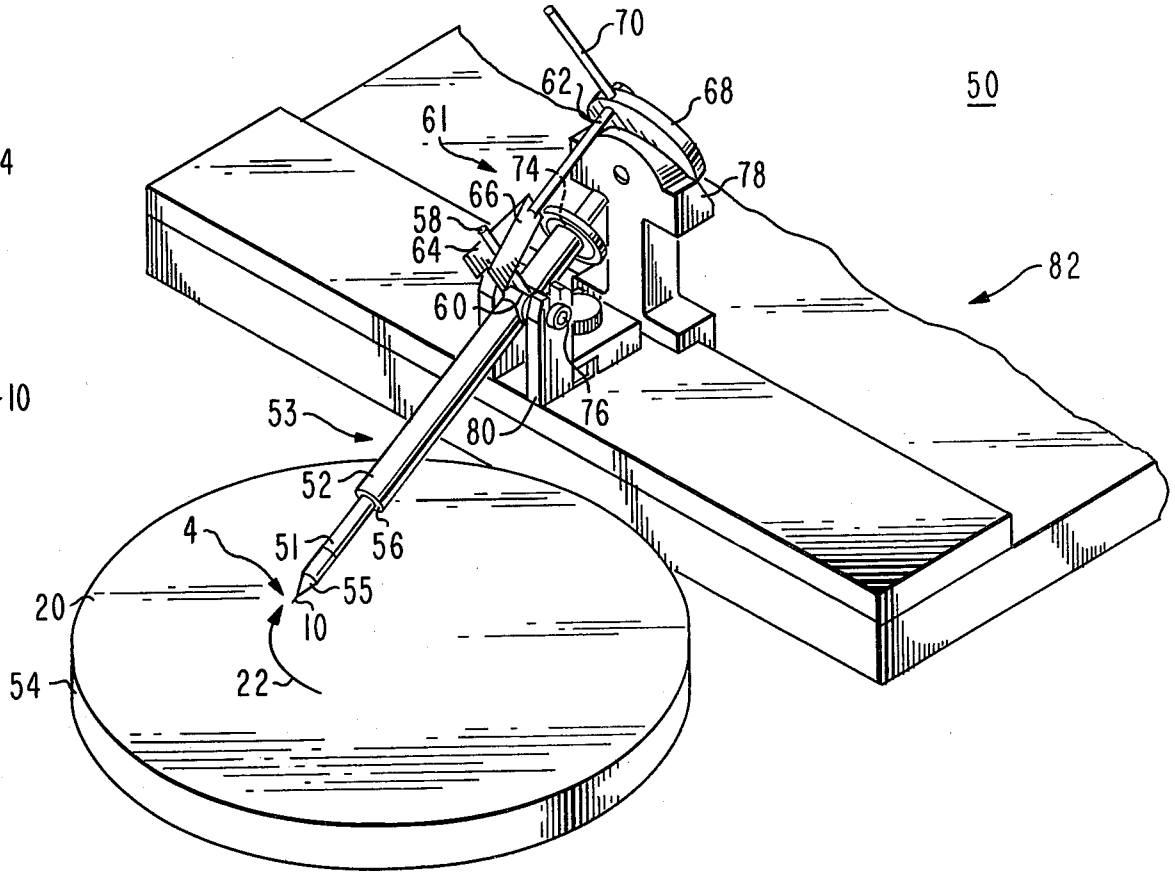
FIG. 9 is a perspective view of an apparatus suitable for carrying out the present invention.

FIG. 9 is a perspective view of a flip-flop grinding apparatus 50 suitable for carrying out the flip-flop grinding of a stylus element 10 as taught in the copending application of Dholakia et al, "Grinding Apparatus," U.S. Ser. No. 292,283 filed Aug. 12, 1981 incorporated herein by reference. The flip-flop grinding apparatus 50 includes a scaife 54 having an abrasive lapping surface 20. The direction of rotation of this scaife is shown by the first arrow 22. The stylus element 10 is mounted in a stylus holder assembly 53 which includes a holding member 51 having a pair of jaws 55 at one end for securely holding the stylus element 10. The holding member 51 is mounted in a shaft 52 by means of a first bearing 56 and a second bearing 74.

The shaft 52 containing the holding member 51 and the stylus element 10 is held on the scaife 54 by means of a pivot bearing 76 such that the desired constant force is applied to the stylus tip region 4 by mass loading. Generally, a force of between about 2 and 5 grams is preferred. Too much force, for example, about 50–100 grams, results in damage to the abrasive lapping surface 20. Too little force, for example, about 0.5 gram, results in a longer time needed to grind the faces 18 and 28 as well as possible increased vibration of the tip region 4 which can cause gouging and non-uniformity of the faces 18 and 28. A slot 60 allows a flipping lever 58 to rotate within a pre-set arc determined by the slot 60 length. The slot 60 length and arc relate to the desired angle between the first flat 18 and the second flat 28.

A fork assembly 61 includes a fork shaft member 62, a first fork member 64 and a second fork member 66. The first fork member 64 and the second fork member 66 may be constructed from a flexible material, e.g., a plastic such as cellulose acetate or polyethylene or a metal sheet such as copper. The first fork member 64 and the second fork member are arranged so as to bracket the flipping lever 58.

The fork shaft member 62 is attached at the end opposite that connected to the first and second fork members 64 and 66, respectively, to an index wheel 68 such that the maximum rotation in one direction of the index wheel 68 corresponds to that for the flipping lever 58 and for a fork member 64 or 66 of the fork assembly 61. Attached to the index wheel 68 is a rocker arm 70, which is used to rotate the index wheel 68 either manually or by mechanical means through an angle somewhat greater, generally about 3 degrees, than that of the slot 60 length through which the flipping lever 58 rotates. The greater angle of rotation of the index wheel 68 causes a small force to be applied to the flipping lever 58 by the first fork member 64 or the second fork member 66 at the ends of the rotation arc. This pressure keeps the flipping lever 58 in position during the lapping of the two flats 18 and 28, in the tip region 4. Generally a force of between about 25 and 50 milligrams, as applied by the fork members 64 and 66, is preferred. Too much force, for example, about 500 milligrams, results in the tip region 4 lifting from the abrasive lapping surface 20. Too little force, for example, about 5 milligrams, may result in the tip region 4 not being lapped in the desired portion.

The index wheel 68 is mounted on a first housing 78 and the pivot bearing 76 is mounted in a second housing 80. The first housing 78 and second housing 80 are mounted on a support 82.

The present invention will be further illustrated by the following Example. However, it is to be understood that the invention is not limited to the details presented therein.

EXAMPLE

A stylus element 10 as shown in FIG. 1 was employed having a cone angle of 50 degrees. The first tip component 6 was an unoriented diamond having a height from the tip end 7 to the interface 12 of 6 milliinches (152 micrometers). The second tip component 8 and the shank 2 were titanium. The shank 2 diameter was 12 milli-inches (305 micrometers). The diamond was bonded to the titanium by brazing. The length of the titanium was 100 milli-inches (25.4 millimeters). The reference flat 14 was employed to orient the stylus element 10.

An electrode surface 16 was lapped into the tip region 4 opposite the reference flat 14 as shown in FIG. 2. The electrode surface 16 made an angle of 30 degrees with the stylus element axis 24.

The two faces 18 and 28 were lapped into the stylus element 10 by means of the flip-flop grinding apparatus 50, as shown in FIG. 9, which was operated manually. A cast iron scaife 54 rotated at 3600 revolutions per minute. The scaife abrasive lapping surface 20 was charged with a diamond powder having an average particle size of 0.1 micrometer.

The index wheel 68 was fabricated out of 3/16 inch (4.77 millimeters) aluminum with a diameter of 1.5 inches (38.1 millimeters). The index wheel 68 was mounted at an angle of 30 to the verticle by means of a $\frac{1}{8}$ inch (3.18 millimeters) pivot pin, not shown. The brass rocker arm 70 was 1.75 inches (4.45 millimeters) long having a diameter of 0.062 inch (1.57 millimeters). The aluminum fork shaft member 62 was $1\frac{7}{8}$ inches (47.6 millimeters) long with a diameter of $\frac{1}{8}$ inch (3.18 millimeters). The fork shaft member 62 was attached to the index wheel 68 by means of a lock nut. The fork members 64 and 66 were 0.005 inch (0.13 millimeter) thick, $\frac{3}{4}$ inch (19.1 millimeters)×5/16 inch (7.94 millimeters) cellulose acetate shim sheets.

An aluminum shaft 52 was 4 inches (10.2 centimeters) long with an outer diameter of 5/16 inch (7.94 millimeters). A 4.5 inch (11.4 centimeters) long aluminum holding member 51 with a $\frac{1}{8}$ inch (3.18 millimeters) diameter was held in place in the shaft 52 by means of two ball bearings 56 and 74. A 0.012 inch (152 micrometers) diameter titanium shank 2 was grasped by a $\frac{1}{2}$ inch (12.7 millimeters) long pair of hardened steel jaws 55, not shown, at the end of the pencil 51.

The axes of the stylus element 10, the holding member 51, and the shaft 52 were aligned at an angle of 30 degrees to the abrasive lapping surface 20.

Initially each region wherein a flat was to be lapped was contacted with the abrasive surface 20 for 5 seconds. The time spent rotating the stylus element 10 between the two regions was 0.5 second. Three complete cycles were run so that the total lapping time for each region was 15 seconds. The time each flat was lapped was then increased to 15 seconds. Six complete cycles were run so that each flat was lapped for 1.5 minutes. The electrode surface angle at tip end 7 after lapping of the flats 18 and 28 was completed was 100 degrees. The angle between the two flats 18 and 28 was 104 degrees. Each flat 18 and 28 was ground at an angle of 30 degrees to the stylus element axis 24. After flip-flop grinding was completed the tip end 7 was centered on the electrode surface 16.

I claim:

1. A method for preparing a capacitive electronic disc playback stylus from a dielectric element having a cone shaped tip comprising a dielectric material wherein the method comprises the steps of:

(a) a lapping an electrode surface in the tip;

(b) contacting a first region of the tip wherein a first flat is lapped with an abrasive lapping surface by a holding device capable of being rotated about an axis extending through the tip region;

(c) rotating the element to a second region wherein a second flat is lapped by rotating said holding device by a flipping lever guided in a pre-determined arc;

(d) applying a predetermined biasing force to said flipping lever by means of a flexible fork assembly drivingly connected to said flipping lever;

(e) contacting the second region of the tip wherein the second flat is lapped with the abrasive lapping surface;

(f) repeating steps (b)-(e) until the two flats have been lapped to substantially the same dimensions; and (g) lapping the region at the tip end to form a disc engaging structure of the desired shape;

wherein the duration for step (b) and step (e) are substantially equal, wherein the duration of step (c) is small compared to the durations of steps (b) and (e).

2. A method in accordance with claim 1 wherein the shape of the disc engaging structure is a keel tip.

3. A method in accordance with claims 1 or 2 wherein the dielectric material is diamond.

4. A method in accordance with claim 1 wherein the element contains a reference surface and said first and second flats are lapped at respective locations determined by said reference surface.

5. A method in accordance with claim 1 wherein the first flat and the second flat are lapped so that they converge at the end of the electrode surface.

* * * * *